United States Patent [19]

Dalphin

[11] Patent Number: 4,785,743

[45] Date of Patent: Nov. 22, 1988

[54] PROTECTED ROOM WITH AN ELECTRICAL INTERRUPTOR AND ITS APPLICATION

[75] Inventor: Claude Dalphin, Paris, France

[73] Assignee: U.S. Philips Corporation, New York, N.Y.

[21] Appl. No.: 944,294

[22] Filed: Dec. 18, 1986

[30] Foreign Application Priority Data

Dec. 20, 1985 [FR] France ..... 85 18918

[51] Int. Cl.[4] ..... G08B 19/00; E05G 3/00

[52] U.S. Cl. ..... 109/40; 109/42; 340/550

[58] Field of Search ..... 109/35, 40–42, 109/49.5; 256/10; 340/550, 109

[56] References Cited

U.S. PATENT DOCUMENTS

| | | | |
|---|---|---|---|
| 1,097,587 | 5/1914 | Hammond | 109/42 |
| 3,763,795 | 10/1973 | Wetz, Jr. | 340/550 |
| 3,825,920 | 7/1974 | Nelson et al. | 340/550 |
| 3,947,837 | 3/1976 | Bitterice | 340/550 |
| 4,234,875 | 11/1980 | Williams | 109/41 |
| 4,712,489 | 12/1987 | Lavavasseur | 109/20 |

FOREIGN PATENT DOCUMENTS

| | | | |
|---|---|---|---|
| 2385872 | 12/1978 | France | 109/42 |

*Primary Examiner*—Neill Wilson

*Attorney, Agent, or Firm*—Anne E. Barschall

[57] ABSTRACT

A protected closed space (L) comprises at least one wall element (E) provided with an electrical interruptor (C1, C2) in turn protected by a thin and flexible probe (S, B) which on the one hand transmits the external mechanical control movement (P) and on the other hand permits the detection of an intrusion at this weak point of the protected closed space. Application: protected closed space with key-board for providing the access code, especially for an electronic payment system.

13 Claims, 3 Drawing Sheets

PROTECTED ROOM WITH AN ELECTRICAL INTERRUPTOR AND ITS APPLICATION

BACKGROUND OF THE INVENTION

1. Field of the Invention

The invention relates to a protected closed space containing electronic means for processing binary data, of which at least one wall element comprises at least one interruptor to be activated by a movement producing the contact between two insulated conductors in the rest position, the interruptor(s) being disposed so as to transmit binary signals from the exterior to the interior of the closed space.

The invention further relates to the application of such a protected closed space to a case containing secret informations, especially for an electronic payment system.

2. Prior Art

Such a case is known from the international PCT application published under No. WO 85/04742, in which an application of payment by credit card is described; since the payment can be made only after verification of a personal authentification code, the code is transmitted to the protected room by means of a key-board.

Other applications, such as electronic tellers or distributors or paper money well known now by the public also comprise a protected closed space and a key-board for supplying an access code.

Such a key-board is constituted by an interruptor assembly and it constitutes a weak point in the wall of the protected closed space.

SUMMARY OF THE INVENTION

The invention has for its object to obviate this disadvantage.

For this purpose, according to the invention, a protected closed space is particularly characterized in that at least the said wall element is provided with a detection probe in the form of a comparatively conductive track for detecting any effort of non-authorized intrusion in the closed space, the said detection probe having at least one thin and flexible part which covers the interruptor and constitutes an electrical barrier through which the movement of controlling the interruptor(s) is mechanically transmitted.

Thus, the presence of a thin and flexible probe covering the interruptor on the one hand permits the mechanical transmission of the control of the interruptor from the exterior to the interior of the protected closed space and on the other hand inhibits the non-authorized intrusion in the protected closed space by detecting any effort of intrusion.

According to the invention, when the said comparatively conductive track of the whole or part of the probe extends mainly parallel to a direction X, a protected closed space is particularly characterized in that it is provided, superimposed on the said probe, with a supplementary probe, whose comparatively conductive track extends mainly parallel to a direction Y substantially at right angles to the direction X.

Thus, an intrusion tool which could successfully be inserted between two tracks of a probe, would not have any chance of being inserted again between two tracks of the other probe.

Since a probe is constituted by narrow comparatively conductive lines obtained by silk screen printing of a conductive ink on a flexible insulating support, a feature according to the invention is that the comparatively conductive track has a high electrical resistance to reduce the consumption of electrical energy.

In fact, in certain applications, for example that described in the aforementioned Patent Application, it is ensured that the case is portable and for this purpose it is provided with an accumulator or a battery, whose lifetime will be longer if the probe consumes a minimum of electrical energy.

According to the invention, a protected closed space is also particularly characterized in that a probe is at least constituted by:

- an opaque layer of aluminium,
- an insulating layer of polyester,
- a layer of discontinuous thickness of a comparatively conductive track obtained by silk screen printing of ink on the basis of laminar silver,
- a layer of a polymerized insulating varnish remaining flexible after polymerization,
- each component being intimately connected to the following component in the order mentioned above by means of a flexible glue comprising a solvent so that the probe is flexible and opaque.

The flexible and thin polyester being transparent, it is advantageous in order to complicate the work of any intruder to add an opaque layer and also to intimately connect the different layers in order that an intruder cannot proceed either by inserting a tool between the tracks he could have seen or by peeling off the different layers of the probe.

In a preferred embodiment in which, the detection probe(s) being connected to a Wheatstone bridge provided with a differential amplifier for amplifying any unbalance of the bridge and in this case transmitting the detection signal, a protected closed space is particularly characterized in that the comparatively conductive track is double to form two tracks arranged so as to be continuously parallel to each other, which are connected to the Wheatstone bridge in such a manner that the two respective currents traversing them are of opposite polarities.

This arrangement is particularly advantageous because on the one hand the probe becomes insensitive to certain similar and simultaneous disturbances in the doubled tracks, which prevents false alarms from being produced, while on the other hand it becomes very risky to attempt to shortcircuit two adjacent tracks hoping to be below the sensitivity threshold of the Wheatstone bridge.

In a general manner, the invention has for its object to reinforce the weak point of a protected closed space, not by preventing the intrusion, but rather by detecting this intrusion, this detection then being utilized to produce an alarm or to take any adequate measure.

BRIEF DESCRIPTION OF THE DRAWING

The invention affords other advantages especially due to certain particularities of technical construction; it will be understood more clearly with the aid of a non-limitative example of an embodiment described with reference to the accompanying drawings, in which.

DETAILED DESCRIPTION OF THE PREFERRED EMBODIMENT

Figure 1:
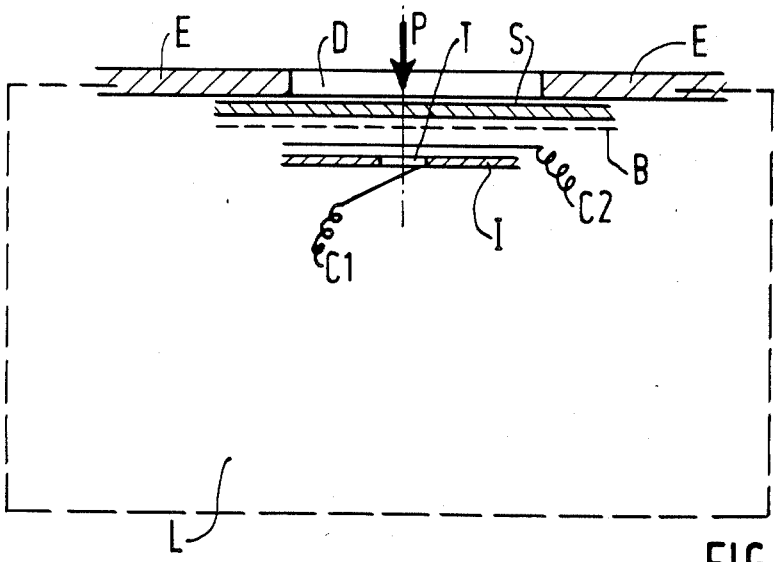
FIG. 1 is a sectional view of an interruptor according to the invention.

FIG. 1 is a sectional view of an interruptor situated at a site D formed in a wall element E of the closed space L. The interruptor comprises two conductors C1 and C2 generally at right angles to each other and separated by an insulator I, in which a recess T is formed. As shown, the two conductors in the rest position do not touch each other. When a movement P is made in the direction of the arrow, the conductor C2 is pushed back until it contacts the conductor C1. When the movement is stopped, an adjustment system or the natural elasticity of the assembly returns the assembly to the rest position shown and there is no contact any longer between the two conductors C1 and C2. The movement P can be directly or indirectly made with a control button.

If the closed space L should be protected by any kind of armouring, such as a concrete wall, etc., the interruptor constitutes as well a weak point thereof.

According to the invention, the effect P is transmitted through a thin and flexible probe constituted by an electrical barrier B fixed on an insulating support S. The electrical barrier B is indicated by broken lines because it is constituted by a comparatively conductive track which meanders over the insulating support S.

Figure 4:
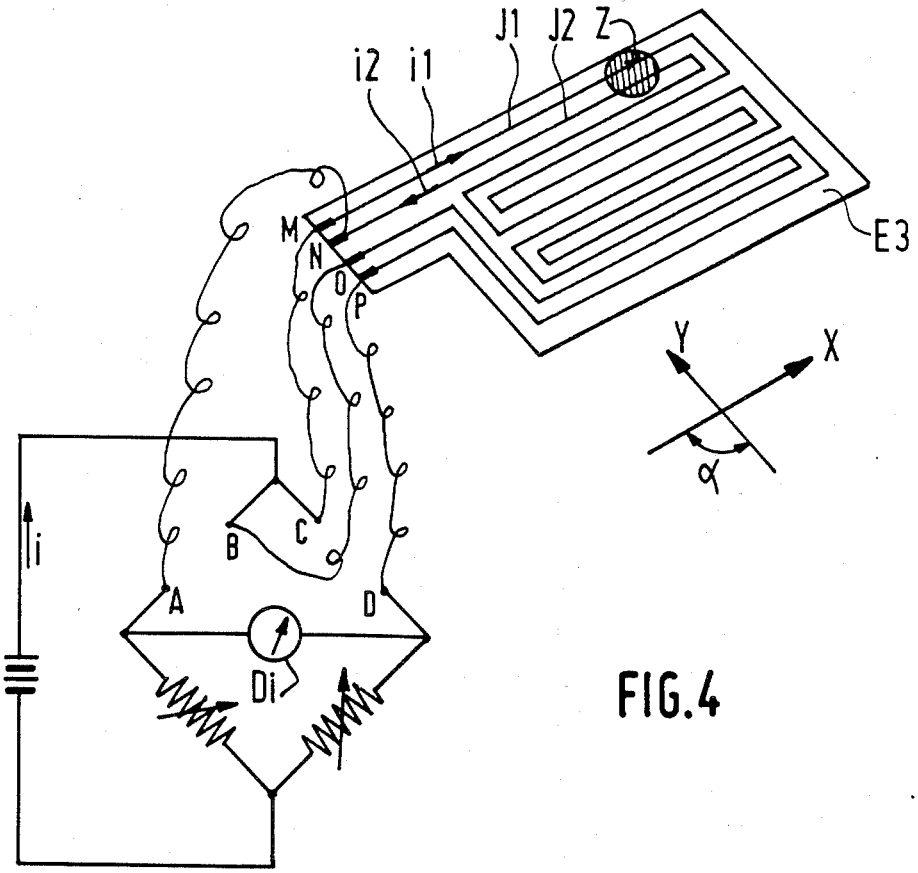
FIG. 4 shows a mode of connection of the double tracks with a single probe.

FIG. 4 shows an embodiment. A probe E3 is shown with its connection to a Wheatstone bridge. Instead of a single track B (FIG. 1), there are now provided two tracks J1 and J2, whose respective courses are substantially parallel to the direction X and are continuously parallel to each other. The track J1 is connected to the branch CD of the Wheatstone bridge, and its resistance has a value R1. The track J2 is connected to the branch AB of the Wheatstone bridge, and its resistance has a value R2, which is not necessarily identical to the value R1, if only because of manufacturing tolerances. Initially, the Wheatstone bridge is balanced in known manner by control means now, during operation, a local mechanical load, for example the movement P or the like, appears in the cross-hatched zone Z, the values R1 and R2 will change. The tracks are fairly narrow, as described hereinafter, in order that the zone Z necessarily covers several tracks. Taking into account the mode of connection of the tracks, the local mechanical load will not lead to unbalance of the Wheatstone bridge because the change of R1 and of R2 resulting therefrom is similar in value and occurs simultaneously in time. If there had been only one track, it is clear that a local load could have unbalanced the Wheatstone bridge and that a false alarm would have been produced.

The symmetry of the connections of the tracks J1 and J2 in two branches of the Wheatstone bridge also leads to an immunity with respect to any electric noise signal, such as, for example, due to induce parasitic signals, and also with respect to a variation in temperature, which variation may be global (for example summer-autumn) as well as local (for example sun rays on the zone Z). This arrangement of double tracks thus ensures that the Wheatstone bridge is unbalanced only in useful cases, i.e. in the cases of efforts of intrusion.

A balanced Wheatstone bridge is well known as a measuring instrument, but it is less commonly known as an instrument for detecting intrusions. According to the invention it has the feature that the connections of the tracks J1 and J2 to the terminals A, B and C, D of the bridge are connections "in series opposition" in such a manner that the currents i1 in J1 and i2 in J2 are of opposite polarities. More precisely, if the connection C M P D has been established, which results in current i1, the second connection must be B O N A, which results in the current i2, and not B N O A. This particularity especially permits a more reliable detection of a short-circuit caused, for example, by a microdrill between adjacent tracks.

Figure 5:
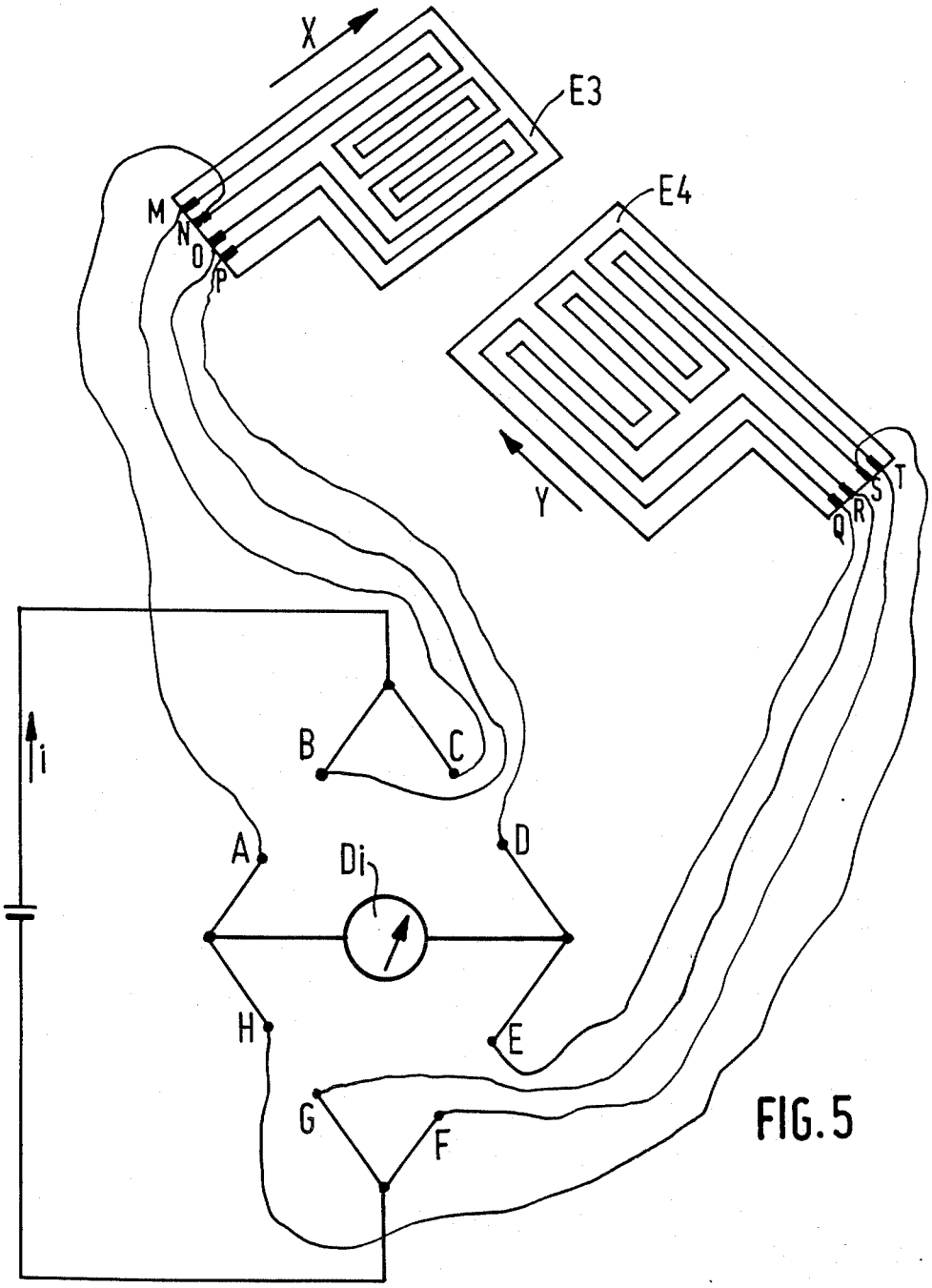
FIG. 5 shows a mode of connection with two probes.

FIG. 5 shows besides the probe E3 a supplementary probe E4 similar to E3; the only important difference between E3 and E4 relates to the general direction of the tracks. In E3 this is the direction X and in E4 this is the direction Y, which is preferably, but not necessarily, perpendicular to X. In order to maintain the same advantages as with E3, the tracks E4 are similarly connected between H and G on the one hand and between E and F on the other hand. Other modes of connection (not shown) can be envisaged without departing from the scope of the invention. For example, it is possible to connect between A and B a track of E3 in series with a track of E4, the two remaining tracks being connected in series between C and D, the terminals H, G, E and F then being available.

For the sake of clarity, the known means for initially balancing the bridge are not shown in FIG. 5. The probes E3 and E4 are represented as two separated elements, but alternatively they may be obtained by an adequate folding from a single element formed by silk screen printing. Otherwise, similar flat one and the same flat element in the form of a hop-scotch track may constitute, after folding, a probe for the six surfaces of a protecting housing.

The detection device Di in FIG. 4 is, for example, a differential amplifier capable of detecting an unbalance of 10 mV. Taking this value into account, it is clear that the devices described above ensure an advantage of "non-detection" of electrical noise signals because the latter can currently induce values higher than 10 mV, such as 50 mV, which consequently should not be detected as efforts of intrusion.

It is also advantageous to construct the probe in such a manner that the consumption of electrical energy is very low, this object is achieved with tracks of high electrical resistance, for example between 2 kΩ and 50 kΩ. Thus, when the supply originates from a battery or from an accumulator, the detection device will have a long lifetime. If the detection device is used for a protected case, the use of accumulators or batteries even provides the advantage that the assembly is then small and transportable with its secret data, which may be, destroyed upon the occurrence of intrusion.

In order to combine these properties, the probe is formed by silk screen printing of a conductive liquid on an insulating support advantageously, the insulating support is a thin and flexible polyester layer and the conductive liquid is composed of resin, of a solvent and of silver powder having a laminar structure. For a protected case having the dimensions 150×110×20 mm, the electrical resistance of a track J1 obtained is then of the order of 15 kΩ with a track width of 0.3 mm, each track being at an axial distance of 0.6 mm from the adjacent track. In the case of a branch as shown in FIG. 5, the equivalent resistance of the bridge is 15 kΩ, which results in a current intensity i of 500 μA at 7 V. Thus, an autonomy of the order of 2 months is obtained with supply means having a reasonable weight and a reasonable volume. Of course the indicated digital values are not limitative.

It is also advantageous to cover the tracks with a varnish layer in order to protect them against oxidation and to insulate them electrically.

The polyester, the resin of the conductive ink and the varnish are chosen so that after drying or evaporation the probe remains flexible.

In a preferred embodiment, the detection probe is provided with an opaque supplementary layer in such a manner that any intruder does not see the site of the tracks through the polyester and/or the varnish which are generally transparent.

The opaque layer is advantageously obtained by means of a thin plate of aluminium.

Figure 2:
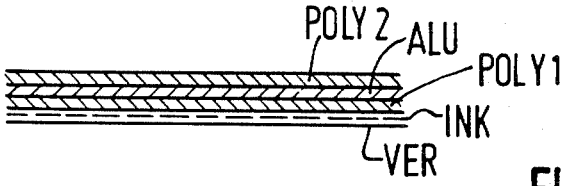
FIG. 2 is a sectional view of a probe obtained by silk screen printing.

A preferred embodiment is shown in FIG. 2, which is a sectional view of a probe terminated by a layer (poly 2) of polyester, a layer (Alu) of aluminium, a layer (poly 1) of polyester, the silk-screen printed conductor circuit (INK) and the protective varnish layer (VER), each component being intimately connected to the following component by means of a flexible glue containing a solvent so that the probe is flexible and opaque.

Figure 3:
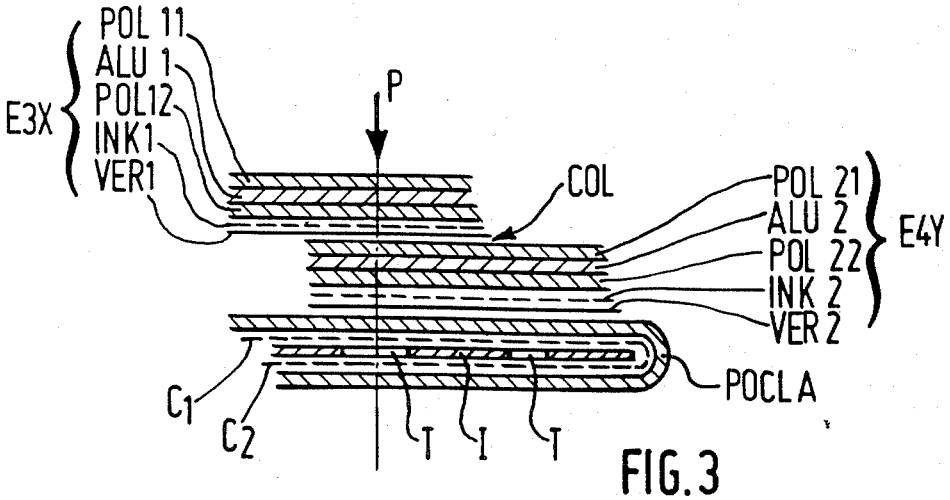
FIG. 3 is a sectional view of a protected interruptor with two superimposed probes.

With such a probe, a preferred embodiment of an interruptor is shown in FIG. 3. Two protection probes (E3X) and (E4Y) are superimposed whilst presenting on the side of the control (P) the polyester layers POL 11 and POL 21, respectively, not obtained by silk screen printing; thus, an intruder could not see the conductors designated here by INK 1 and INK 2, respectively. It is advantageous to connect the aluminium layers ALU 1 and ALU 2 either to earth or to a given potential. It is also advantageous to glue (COL) with a polyurethane glue, which remains flexible after polymerization, the two protection elements E3X and E4Y on their opposite surfaces, i.e. the varnish VER 1 and the polyester POL 21. The layers POL 11 and POL 21 can appear to be superfluous, but it is found that the varnish (VER 1) can be glued more readily to polyester (POL 21) than to aluminium (ALU 2), which justifies the presence of the layer of polyester (POL 21) or (POLY 2) (in FIG. 2), and the presence in accordance with standardization and supply, of the layer of polyester (POL 11). It is clear that in this case an improvement is concerned, which is not indispensable for the manufacture of an interruptor according to the invention. For a clear understanding of the system, FIG. 3 shows the electrical part of the interruptor with the conductors C1, C2 insulated by an insulator I, in this case preferably doublefaced self-gluing means provided with recesses (T); the conductors to be connected C1, C2 are generally formed on a foldable support (POCLA) to obtain a key-board, but there are also other embodiments, such as, for example, that described in FIG. 6 of the aforementioned PCT document.

By way of example:

an opaque layer of aluminium has a thickness lying between 7 μm and 20 μm, preferably 12 μm;

an insulating layer of polyester has a thickness lying between 15 μm and 30 μm, preferably 23 μm;

the thickness of a silk-screen printed track lies between 4 μm and 15 μm;

the thickness of the varnish lies between 10 μm and 40 μm, preferably 20 μm;

the thickness of each glue layer is practically negligible and is at any rate less than 10 μm so that this results in that the overall thickness of the two detection elements E3X and E4Y shown in FIG. 3 is of the order of 180 μm of materials having the resilience and flexibility necessary to transmit the control movement (P) to the conductor C1 to be connected to the conductor (C2).

What is claimed is:

1. Apparatus for protecting a closed space, the apparatus comprising:

a plurality of walls defining an interior and an exterior of the space, at least one of the walls containing at least one interruptor which includes first and second conductors and means for producing electrical contact between the first and second conductors in response to a movement, so that binary signals are transmitted from the exterior to the interior of the closed space; and a probe for detecting attempts at unauthorized intrusion into the space, which probe comprises a comparatively conductive track having at least one relatively thin and flexible part for covering the interruptor, the thin and flexible part acting as a barrier through which the movement is transmitted, so that the probe improves protection in the wall which contains the interruptor without impairing functioning of the interruptor.

2. The apparatus of claim 1 wherein the probe comprises:

a. a flexible insulating support; and b. conductive ink placed on the flexible insulating support by silk screen printing, so the conductive ink forms the comparatively conductive track and so that the comparatively conductive track has a high electrical resistance, whereby consumption of electrical energy is reduced.

3. The apparatus of claim 2 wherein the probe has an electrical resistance between 2 kΩ and 50 kΩ.

4. The apparatus of claim 1 wherein:

a. the comparatively conductive track extends substantially parallel to a first direction X; and b. the probe comprises a second comparatively conductive track which extends substantially parallel to a second direction Y, the second direction Y being substantially perpendicular to the first direction X.

5. Apparatus for protecting a closed space, a plurality of walls defining an interior and an exterior of the space, at least one of the walls containing at least one interruptor which includes first and second conductors and means for producing electrical contact between the first and second conductors in response to a movement, so that binary signals are transmitted from the exterior to the interior of the closed space, the apparatus comprising:

a probe for detecting attempts at unauthorized intrusion into the space, which probe comprises a comparatively conductive track having at least one relatively thin and flexible part for covering the interruptor, the thin and flexible part acting as a barrier through which the movement is transmitted, whereby the probe improves protection in the wall which contains the interruptor without impairing the function of the interruptor;

wherein:

a. the comparatively conductive track extends substantially parallel to a first direction X; and b. the probe comprises a second comparatively conductive track which extends substantially parallel to a second direction Y, the second direction Y being substantially perpendicular to the first direction X; and wherein the probe comprises:

c. first and second flexible insulating supports; and d. conductive ink placed on the flexible insulating supports by silk screen printing, so the conductive ink forms the comparatively conductive track and the secondl comparatively conductive track, and so that the comparatively conductive track and the second comparatively conductive track have a high electrical resistance, whereby consumption of electrical energy is reduced.

6. The apparatus of claim 5 wherein the probe has an electrical resistance value between 2 kΩ and 50 kΩ.

7. Apparatus for protecting a closed space, a plurality of walls defining an interior and an exterior of the space, at least one of the walls containing at least one interruptor which includes first and second conductors and means for producing electrical contact between the first and second conductors in response to a movement, so that binary signals are transmitted from the exterior to the interior of the closed space, the apparatus comprising:

a probe for detecting attempts at unauthorized intrusion into the space, which probe comprises a comparatively conductive track having at least one relatively thin and flexible part for covering the interruptor, the thin and flexible part acting as a barrier through which the movement is transmitted, whereby the probe improves protection in the wall which contains the interruptor without impairing the function of the interruptor wherein:

a. the comparatively conductive track extends substantially parallel to a first direction X; and b. the probe comprises a second comparatively conductive track which extends substantially parallel to a second direction Y, the second direction Y being substantially perpendicular to the first direction X; and wherein the probe comprises a first and second plurality of layers fixed to one another by means of a flexible glue containing a solvent, each plurality of layers comprising the following, fixed together in the order indicated:

a. an opaque layer of aluminum;

b. an insulating layer of polyester;

c. a layer comprising the comparatively conductive track, wherein the comparatively conductive track is formed by silk screen printing ink on a base of laminar silver, whereby the conductive track layer is of discontinuous thickness;

d. a layer of polymerized insulating varnish, which remains flexible after polymerization;

whereby the probe is flexible and opaque and whereby each of layers a–d are separated by one of a plurality of layers of glue.

8. The apparatus of claim 7 wherein:

a. the aluminum layer has a thickness between 7 μm and 20 μm;

b. the insulating polyester layer has a thickness between 15 μm and 30 μm;

c. the comparatively conductive track has a thickness between 4 μm and 15 μm;

d. the varnish layer having a thickness between 10 μm and 40 μm;

e. the glue layers each having a thickness of less than 10 μm, whereby the thickness of the glue layers is negligible;

whereby the probe has a thickness between 40 μm and 150 μm.

9. Apparatus for protecting a closed space, a plurality of walls defining an interior and an exterior of the space, at least one of the walls containing at least one interruptor which includes first and second conductors and means for producing electrical contact between the first and second conductors in response to a movement, so that binary signals are transmitted from the exterior to the interior of the closed space, the apparatus comprising:

a probe for detecting attempts at unauthorized intrusion into the space, which probe comprises a comparatively conductive track having at least one relatively thin and flexible part for covering the interruptor, the thin and flexible part acting as a barrier through which the movement is transmitted, whereby the probe improves protection in the wall which contains the interruptor without impairing the function of the interruptor wherein the probe comprises a plurality of layers fixed to one another by means of a flexible glue containing a solvent, the plurality of layers comprising the following, fixed together in the order indicated:

a. an opaque layer of aluminum;

b. an insulating layer of polyester;

c. a layer comprising the comparatively conductive track, wherein the comparatively conductive track is formed by silk screen printing ink on a base of laminar silver, whereby the conductive track layer is of discontinuous thickness;

d. a layer of polymerized insulating varnish, which remains flexible after polymerization;

whereby the probe is flexible and opaque and whereby each of layers a–d are separated by one of a plurality of layers of glue.

10. The apparatus of claim 9 wherein:

a. the aluminum layer has a thickness between 7 μm and 20 μm;

b. the insulating polyester layer has a thickness between 15 μm and 30 μm;

c. the comparatively conductive track has a thickness between 4 μm and 15 μm;

d. the varnish layer having a thickness between 10 μm and 40 μm;

e. the glue layers each having a thickness of less than 10 μm, whereby the thickness of the glue layers is negligible;

whereby the probe has a thickness between 40 μm and 150 μm.

11. The apparatus of claim 1, 2, 3, 9, or 10, wherein:

a. the comparatively conductive track comprises first and second sub-tracks, the first and second sub-tracks being substantially parallel to one another, whereby the movement activating the interruptor has a substantially equal effect on the conductivity of the first and second sub-tracks and whereby a movement resulting from an attempt at unauthorized intrusion has an unequal effect on the conductivity of the first and second sub-tracks; and comprising:

b. a balanced Wheatstone bridge coupled with the probe so that the first and second sub-tracks act as impedances of the bridge and so that respective first and second currents in the first and second tracks have opposite polarities, the bridge comprising a differential amplifier for amplifying any unbalance of the bridge and providing a detection signal when there is an unbalance.

12. The apparatus of claim 4, 5, 6, 7, or 8, wherein:

a. the comparatively conductive track and the second comparatively conductive track each comprise first and second sub-tracks, the respective first and second sub-tracks being substantially parallel to one another, whereby the movement activating the interruptor has a substantially equal effect on the conductivity of the respective first and second sub-tracks and whereby a movement resulting from an attempt at unauthorized intrusion has an unequal effect on the conductivity of the respective first and second sub-tracks; and comprising:

b. a balanced Wheatstone bridge coupled with the probe so that the respective first and second sub-tracks act as impedances of the bridge and so that respective first and second currents in the respective first and second tracks have opposite polarities, the bridge comprising a differential amplifier for amplifying any unbalance of the bridge and providing a detection signal when there is an unbalance.

13. The apparatus of claim 1 wherein a. the walls form a portable protective case for storing secret information;

b. the probe emits a detection signal in case of intrusion; and c. the case contains means for destroying contents of the case under control of the detection signal.

* * * * *